US006388541B1

(12) United States Patent
Hiratsuka et al.

(10) Patent No.: US 6,388,541 B1
(45) **Date of Patent: *May 14, 2002**

(54) DIELECTRIC RESONATOR HAVING AN ELECTROMAGNETIC WAVE ABSORBING MEMBER AND APPARATUS INCORPORATING THE DIELECTRIC RESONATOR

(75) Inventors: Toshiro Hiratsuka, Kusatsu; Tomiya Sonoda, Muko; Kenichi Iio, Nagaokakyo, all of (JP)

(73) Assignee: Murata Manufacturing Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,687

(22) Filed: Mar. 25, 1998

(30) Foreign Application Priority Data

Mar. 26, 1997 (JP) ..... 9-073586
Mar. 11, 1998 (JP) ..... 10-059902

(51) Int. Cl.[7] ..... H01P 7/10; H01P 1/213

(52) U.S. Cl. ..... 333/134; 333/202; 333/219.1

(58) Field of Search ..... 333/126, 129, 333/132, 134, 202, 219.1, 251

(56) References Cited

U.S. PATENT DOCUMENTS 5,164,358 A 11/1992 Buck et al. ..... 505/1

FOREIGN PATENT DOCUMENTS

| | | | | |
|---|---|---|---|---|
| EP | 0734088 | * | 9/1996 | ..... 333/219.1 |
| JP | 63-290401 | * | 11/1988 | ..... 333/202 |
| JP | 9-246820 | * | 9/1997 | ..... 333/202 |

* cited by examiner

*Primary Examiner*—Justin P. Bettendorf
(74) *Attorney, Agent, or Firm*—Ostrolenk, Faber, Gerb & Soffen, LLP

(57) ABSTRACT

There is provided a dielectric resonator which can suppress a spurious output acting as unnecessary resonance and can prevent the out-of-band characteristics of a filter from being degraded. Electrodes having circular openings are formed on a dielectric substrate, and the dielectric substrate is arranged between upper and lower conductive cases. A resonance region is used as a portion between the openings of the dielectric substrate, and columnar members consisting of a wave absorber are arranged between the upper and lower conductive cases.

10 Claims, 9 Drawing Sheets

DIELECTRIC RESONATOR HAVING AN ELECTROMAGNETIC WAVE ABSORBING MEMBER AND APPARATUS INCORPORATING THE DIELECTRIC RESONATOR

BACKGROUND OF THE INVENTION

1. Field of the Invention

The present invention relates to a dielectric resonator, a dielectric filter, a sharing device, and a communication apparatus which are used in a microwave band, a millimeter wave band, or the like.

2. Description of the Related Art

In recent years, a communication system achieving a large capacity and a high speed has been required in accordance with a rapid increase in demand of a mobile communication system or multimedia systems. With such an increase in amount of information to be communicated, a use frequency band has been extended from a microwave band to a millimeter wave band. Even in the millimeter wave band, a TE01δ mode dielectric resonator constituted by a conventionally known cylindrical dielectric material can be used in a manner in the microwave band. At this time, severe processing precision is required because the resonance frequency of the TE01δ mode dielectric resonator is determined depending on the external size of the cylindrical dielectric material. However, a precise size cannot be set with respect to the resonance frequency because of a factor such as contraction or the like of the dielectric material in sintering.

When a plurality of TE01δ mode dielectric resonators are arranged at predetermined intervals in a metal case to constitute a dielectric filter, coupling between an input/output means such as a metal loop and a dielectric resonator or between dielectric resonators is determined by the distance therebetween. For this reason, the resonators and the like must be arranged at a high a positional precision.

Therefore, the present inventor proposes, in Japanese Patent Application No. 7-62625, a dielectric resonator which solves the above problems and is excellent in processing precision and a dielectric filter which is excellent in positional precision.

The basic arrangement of a dielectric filter according to this application is shown in FIG. 12. FIG. 12 is an exploded perspective view of the dielectric filter according to this application.

As shown in FIG. 12, a dielectric filter 101 is constituted by a dielectric substrate 102 and upper and lower conductive cases 103 and 104.

The dielectric substrate 102 is a substrate having a predetermined specific inductive capacity. An electrode 102*a* is entirely formed on one major surface of the substrate except for three circular openings 102*c* each having a predetermined size, and an electrode 102*b* is entirely formed on the other major surface except for three circular openings 102*db* each having a predetermined size. The three openings 102*c* in one major surface oppose the three openings 102*d* in the other major surface, respectively.

The upper conductive case 103 consists of a metal, and has a box-like shape which opens downward. The upper conductive case 103 is arranged near the openings 102*c* of the electrode 102*a* to be spaced apart from the dielectric substrate 102.

The lower conductive case 104 consists of a dielectric material, and has a box-like shape which opens upward and has flanges projecting from the side surfaces of the lower conductive case 104. A shielding conductor 106 is formed on the inner peripheral surface of the lower conductive case 104, and input/output electrodes 105*a* and 105*b* are formed at positions opposing both the end openings 102*d* of the three openings 102*d* of the electrode 102*b* such that the input/output electrodes 105*a* and 105*b* are insulated from the shielding conductor 106. The input/output electrodes 105*a* and 105*b* are led from holes 104*a* and 104*b* formed in the side surface of the lower conductive case 104. In addition, a spacer 107 for keeping a predetermined interval between the inner bottom surface of the lower conductive case 104 on which the shielding conductor 106 is formed and the dielectric substrate 102 is arranged in the lower conductive case 104. The spacer 107 consists of a dielectric material having a low dielectric constant not to disturb electromagnetic fields in the upper and lower conductive cases 103 and 104.

When this structure is used, electromagnetic field energy is confirmed by the dielectric substrate 102 near a portion sandwiched by the three openings 102*c* and 102*d* in which the electrode 102*a* opposes the electrode 102*b*, and three resonators can be achieved. For this reason, a dielectric filter having a three-stage resonator can be obtained.

With this arrangement, since a resonance region can be defined by the size of an opening portion of an electrode, a method such as etching can be used, and a dielectric filter which can extremely accurately reproduce dimensional precision of a resonator with respect to a resonance frequency and positional precision between resonances can be formed.

However, an unnecessary TEM mode electromagnetic wave may be generated by the electrode edge portions of the openings of the electrodes 102*a* and 102*b* formed on the dielectric substrate 102. Such a TEM wave transmits between the electrodes 102*a* and 102*b* formed on the dielectric substrate 102 to be reflected by the end face of the dielectric substrate 102 to generate a standing wave, so that resonance occurs in the structure. This standing wave operates as a spurious output with respect to the filter characteristics of the dielectric filter 101 itself to affect the out-of-band characteristics of the filter. As a result, the filter characteristics of the dielectric filter 101 itself may be degraded.

An unnecessary TEM mode electromagnetic wave generated by the electrode edge portions of the openings of the electrodes 102*a* and 102*b* formed on the dielectric substrate 102 transmits between the electrode 102*a* and the conductor 104*a* or the electrode 102*b* and the conductor 104*b* to be reflected by the end portion of the dielectric substrate 102 to generate a standing wave, so that resonance occurs in the structure. This standing wave also operates as a spurious output with respect to the filter characteristics of the dielectric filter 101 itself to affect the out-of-band characteristics of the filter. As a result, the filter characteristics of the dielectric filter 101 itself may be degraded.

SUMMARY OF THE INVENTION

The present invention has been made to solve the above problems, and has as its object to provide a dielectric filter which can suppress a spurious output acting as unnecessary resonance to prevent the out-of-band characteristics of the filter from being degraded.

A dielectric resonator according to the first aspect comprises a dielectric substrate, a first conductor formed on one major surface of the dielectric substrate, a second conductor formed on the other major surface of the dielectric substrate, a first opening formed in the first conductor to expose the dielectric substrate from the first conductor, a second opening formed in the second conductor to expose the dielectric substrate from the second conductor, a first conductive plate arranged to be spaced apart from the first conductor and to cover at least the first opening, a second conductive plate arranged to be spaced apart from the second conductor and to cover at least the second opening, a resonance portion determined by the first opening and the second opening, and an electromagnetic wave absorbing member arranged between the first and second conductive plates.

In this manner, an electromagnetic wave in a mode in which unnecessary resonance occurs can be absorbed by the electromagnetic wave absorbing member.

In a dielectric resonator according to the second aspect, the electromagnetic wave absorbing member is arranged between at least one of the first and second conductive plates and the dielectric substrate.

In this manner, an unnecessary TEM mode electromagnetic wave generated by the electrode edge portions of the openings of the electrodes 102*a* and 102*b* formed on the dielectric substrate 102 and transmitting between the electrode 102*a* and the conductor 104*a* or the electrode 102*b* and the conductor 104*b* can be absorbed, and unnecessary resonance can be reduced.

In a dielectric resonator according to third aspect, the electromagnetic wave absorbing member is arranged to be in contact with a side surface perpendicular to both the major surfaces of the dielectric substrate.

In this manner, an unnecessary TEM mode electromagnetic wave generated by the electrode edge portions of the openings of the electrodes 102*a* and 102*b* formed on the dielectric substrate 102 and transmitting between the electrodes 102*a* and 102*b* can be absorbed, and unnecessary resonance can be reduced.

A dielectric filter according to the fourth aspect comprises a dielectric substrate, a first conductor formed on one major surface of the dielectric substrate, a second conductor formed on the other major surface of the dielectric substrate, a first opening formed in the first conductor to expose the dielectric substrate from the first conductor, a second opening formed in the second conductor to expose the dielectric substrate from the second conductor, a first conductive plate arranged to be spaced apart from the first conductor and to cover at least the first opening, a second conductive plate arranged to be spaced apart from the second conductor and to cover at least the second opening, a resonance portion determined by the first opening and the second opening, input/output means coupled to the resonance portion, and an electromagnetic wave absorbing member arranged between the first and second conductive plates.

In this manner, an electromagnetic wave in a mode in which a spurious output is generated can be absorbed by the electromagnetic wave absorbing member.

In a dielectric filter according to the fifth aspect, the electromagnetic wave absorbing member is arranged between at least one of the first and second conductive plates and the dielectric substrate.

In this manner, an unnecessary TEM mode electromagnetic wave generated by the electrode edge portions of the openings of the electrodes 102*a* and 102*b* formed on the dielectric substrate 102 and transmitting between the electrode 102*a* and the conductor 104*a* or the electrode 102*b* and the conductor 104*b* can be absorbed, and an unnecessary spurious output can be reduced.

In a dielectric filter according to the sixth aspect, the electromagnetic wave absorbing member is arranged to be in contact with a side surface perpendicular to both the major surfaces of the dielectric substrate.

In this manner, an unnecessary TEM mode electromagnetic wave generated by the electrode edge portions of the openings of the electrodes 102*a* and 102*b* formed on the dielectric substrate 102 and transmitting between the electrodes 102*a* and 102*b* can be absorbed, and an unnecessary spurious output can be reduced.

A sharing device according to the seventh aspect comprises: at least a first filter and a second filter; the first filter including a dielectric substrate, a first conductor formed on one major surface of the dielectric substrate, a second conductor formed on the other major surface of the dielectric substrate, a first opening formed in the first conductor to expose the dielectric substrate from the first conductor, a second opening formed in the second conductor to expose the dielectric substrate from the second conductor, a first conductive plate arranged to be spaced apart from the first conductor and to cover at least the first opening, a second conductive plate arranged to be spaced apart from the second conductor and to cover at least the second opening, a resonance portion determined by the first opening and the second opening, and input/output means coupled to the resonance portion, and the second filter including a dielectric substrate, a first conductor formed on one major surface of the dielectric substrate, a second conductor formed on the other major surface of the dielectric substrate, a first opening formed in the first conductor to expose the dielectric substrate from the first conductor, a second opening formed in the second conductor to expose the dielectric substrate from the second conductor, a first conductive plate arranged to be spaced apart from the first conductor and to cover at least the first opening, a second conductive plate arranged to be spaced apart from the second conductor and to cover at least the second opening, a resonance portion determined by the first opening and the second opening, and input/output means coupled to the resonance portion; common input/output means which connects one of the input/output means of the first filter to one of the input/output means of the second filter; and an electromagnetic wave absorbing member arranged at at least one of a position between the first and second conductive plates of the first filter and a position between the first and second conductive plates of the second filter.

In this manner, an electromagnetic wave in a mode in which a spurious output is generated can be absorbed by the electromagnetic wave absorbing member.

In a sharing device according to the eighth aspect, the electromagnetic wave absorbing member is arranged at at least one of a position between at least one of the first and second conductive plates of the first filter and the dielectric substrate and a position between at least one of the first and second conductive plates of the second filter and the dielectric substrate.

In this manner, an unnecessary TEM mode electromagnetic wave generated by the electrode edge portion of the opening of the electrode formed on the dielectric substrate and transmitting between the electrode and the conductor can be absorbed, and an unnecessary spurious output can be reduced.

In a sharing device according to the ninth aspect, the electromagnetic wave absorbing member is arranged to separate the resonance portion of the first filter and the resonance portion of the second filter from each other.

In this manner, resonance occurring in the resonance portion of the first filter and resonance occurring in the resonance portion of the second filter can be prevented from being interfered to each other.

In a sharing device according to the tenth aspect, the electromagnetic wave absorbing member is arranged to be in contact with at least one of a side surface perpendicular to both the major surfaces of the dielectric substrate of the first filter and a side surface perpendicular to both the major surfaces of the dielectric substrate of the second filter.

In this manner, an unnecessary TEM mode electromagnetic wave generated by the electrode edge portion of the opening of the electrode formed on the dielectric substrate and transmitting between the electrode and the conductor can be absorbed, and an unnecessary spurious output can be reduced.

A communication apparatus according to the eleventh aspect comprises at least a sharing device, a transmission circuit, a reception circuit, and an antenna, wherein the sharing device includes: a first filter having a dielectric substrate, a first conductor formed on one major surface of the dielectric substrate, a second conductor formed on the other major surface of the dielectric substrate, a first opening formed in the first conductor to expose the dielectric substrate from the first conductor, a second opening formed in the second conductor to expose the dielectric substrate from the second conductor, a first conductive plate arranged to be spaced apart from the first conductor and to cover at least the first opening, a second conductive plate arranged to be spaced apart from the second conductor and to cover at least the second opening, a resonance portion determined by the first opening and the second opening, and input/output means coupled to the resonance portion; a second filter having a dielectric substrate, a first conductor formed on one major surface of the dielectric substrate, a second conductor formed on the other major surface of the dielectric substrate, a first opening formed in the first conductor to expose the dielectric substrate from the first conductor, a second opening formed in the second conductor to expose the dielectric substrate from the second conductor, a first conductive plate arranged to be spaced apart from the first conductor and to cover at least the first opening, a second conductive plate arranged to be spaced apart from the second conductor and to cover at least the second opening, a resonance portion determined by the first opening and the second opening, input/output means coupled to the resonance portion; common input/output means which connects one of the input/output means of the first filter to one of the input/output means of the second filter; and an electromagnetic wave absorbing member arranged at at least one of a position between the first and second conductive plates of the first filter and a position between the first and second conductive plates of the second filter, the transmission circuit is connected to the first filter, the reception circuit is connected to the second filter, and the antenna is connected to the common input/output means.

In this manner, an electromagnetic wave in a mode in which a spurious output is generated can be absorbed by the electromagnetic wave absorbing member.

In a communication apparatus according to the twelfth aspect, the electromagnetic wave absorbing member is arranged at at least one of a position between at least one of the first and second conductive plates of the first filter and the dielectric substrate and a position between at least one of the first and second conductive plates of the second filter and the dielectric substrate.

In this manner, an unnecessary TEM mode electromagnetic wave generated by the electrode edge portion of the opening of the electrode formed on the dielectric substrate and transmitting between the electrode and the conductor can be absorbed, and an unnecessary spurious output can be reduced.

In a communication apparatus according to the thirteenth aspect, the electromagnetic wave absorbing member is arranged to separate the resonance portion of the first filter and the resonance portion of the second filter from each other.

In this manner, a signal on the reception side and a signal on the transmission side can be prevented from being interfered to each other.

DESCRIPTION OF THE PREFERRED EMBODIMENTS

Figure 1:
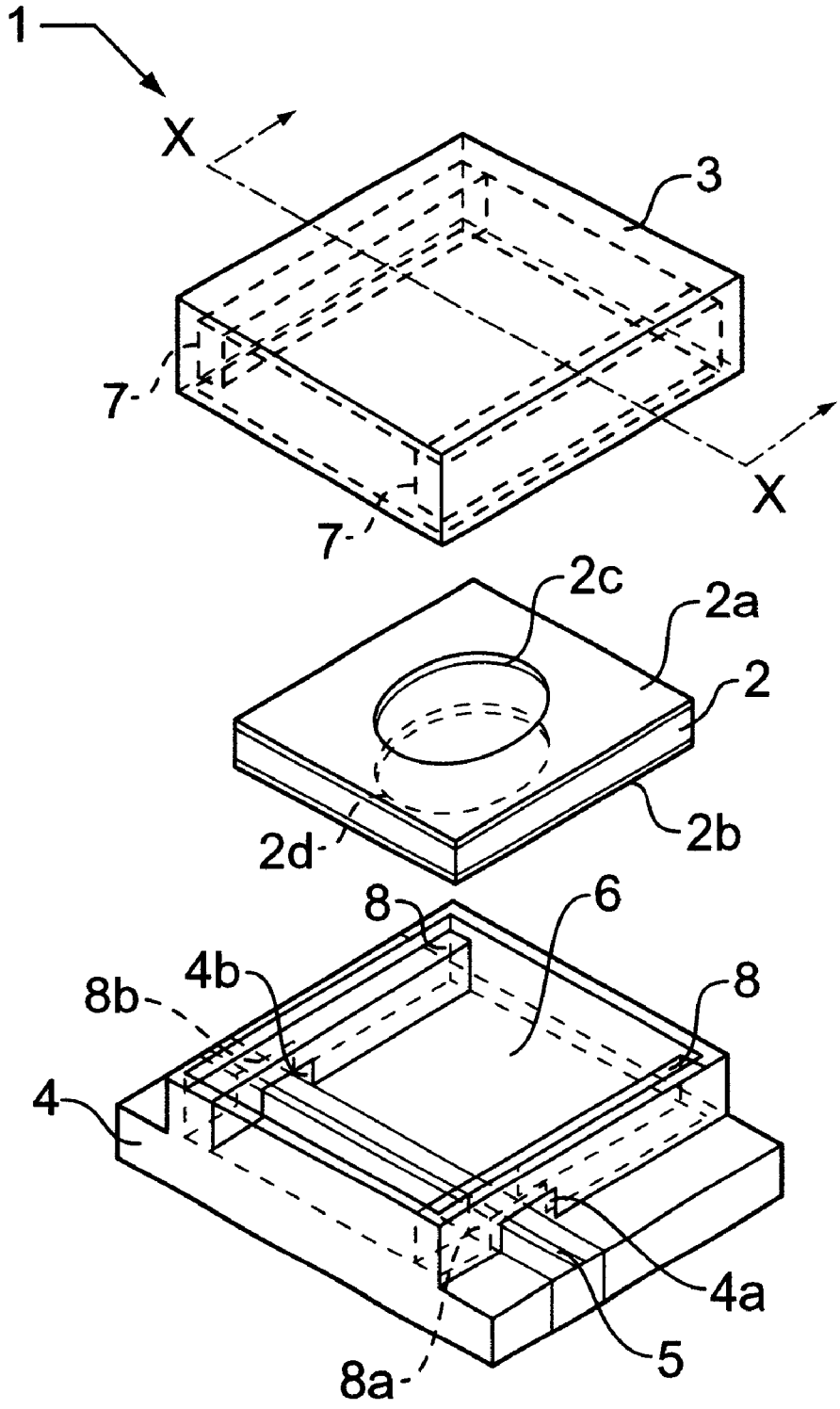
FIG. 1 is an exploded perspective view of a dielectric resonator according to the first embodiment.
Figure 2:
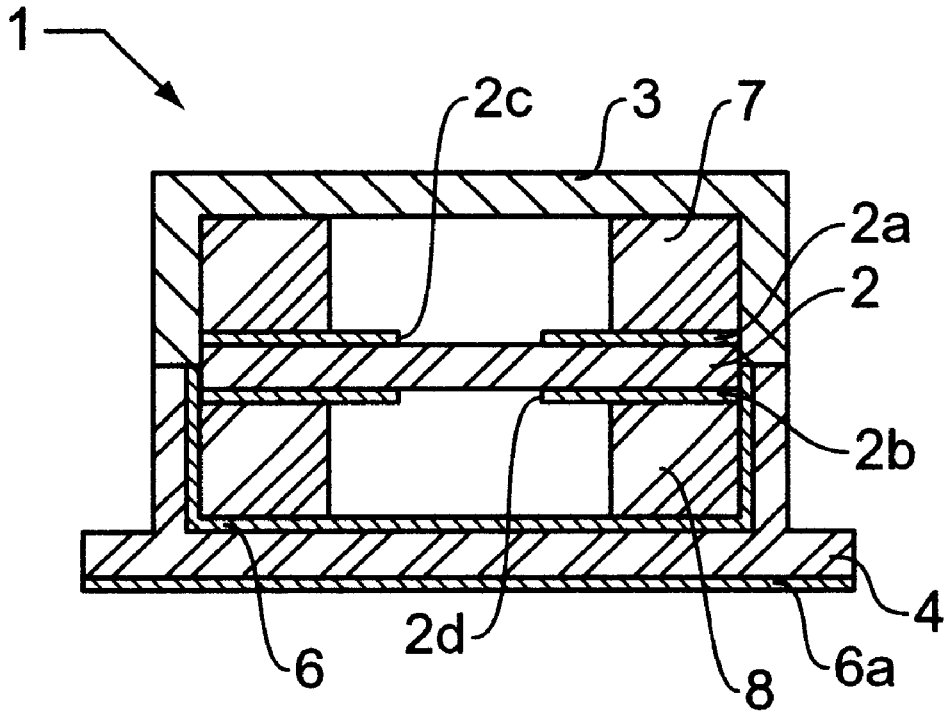
FIG. 2 is a sectional view showing the dielectric resonator along an X—X line in FIG. 1.

The first embodiment of the present invention will be described below with reference to FIGS. 1 and 2. FIG. 1 is an exploded perspective view of a dielectric resonator 1 according to this embodiment, and FIG. 2 is a sectional view showing the dielectric resonator 1 along a X—X line in FIG. 1.

As shown in FIG. 1, the dielectric resonator 1 is constituted by a dielectric substrate 2 having electrodes which are formed on both the major surfaces thereof and upper and lower conductive cases 3 and 4.

The dielectric substrate 2 has a predetermined specific inductive capacity, and an electrode 2*a* having one circular opening 2*c* and an electrode 2*b* having one circular opening 2*d* are formed on both the major surfaces of the dielectric substrate 2 such that the openings 2*c* and 2*d* oppose.

The upper conductive case 3 consists of a metal, and has a box-like shape which opens downward. The upper conductive case 3 is arranged near the opening 2*c* of the electrode 2*a* to be spaced apart from the dielectric substrate 2.

The lower conductive case 4 consists of a dielectric material, and has a box-like shape which opens upward and has flanges projecting from the side surfaces of the lower conductive case 4. A shielding conductor 6 is formed on the inner peripheral surface of the lower conductive case 4, and a ground conductor 6*a* is formed on the lower surface of the lower conductive case 4. A microstrip line electrode 5 is formed at a position opposing the opening 2*d* of the electrode 2*b* to be insulated from the shielding conductor 6. The microstrip line electrode 5 is led from holes 4*a* and 4*b* formed in the side surface of the lower conductive case 4.

Columnar members 7 consisting of a wave absorber are arranged between the inner ceiling surface of the upper conductive case 3 and the dielectric substrate 2.

As in the above arrangement, columnar members 8 consisting of a wave absorber are arranged between the inner bottom surface of the lower conductive case 4 and the dielectric substrate 2. A notch 8*a* is formed in the columnar member 8 such that the columnar members 8 is not in contact with the microstrip line electrode 5.

FIG. 2 is a sectional view showing the dielectric resonator 1 along an X—X line in FIG. 1 viewed in the direction of an arrow. As shown in FIG. 2, the columnar members 7 and 8 also function as spacers. That is, the columnar member 7 keeps the interval between the dielectric substrate 2 and the upper conductive case 3 constant, and the columnar member 8 keeps the interval between the dielectric substrate 2 and the lower conductive case 4 constant.

When the columnar members 7 and 8 consisting of the wave absorber are arranged between the electrodes 2*a* and 2*b* of the dielectric substrate 2 and the upper and lower conductive cases 3 and 4 as described above, an unnecessary mode electromagnetic wave can be prevented from transmitting between the electrodes 2*a* and 2*b* of the dielectric substrate 2 and the upper and lower conductive cases 3 and 4.

In this embodiment, the columnar member consisting of a wave absorber is used. However, the present invention is not limited to the embodiment, and, for example, an annular member may be used. At this time, when the member is shaped to surround the openings 2*c* and 2*d*, the best effect of suppressing an unnecessary mode electromagnetic wave can be obtained. For this reason, this shape is preferably used.

As such a wave absorber, ferrite or carbon is used. A wave absorber or the like obtained by containing carbonyl iron in a plastic or a resin may also be used. In addition, another wave absorber may be used. For example, it is also considered to use a wave absorber described in "Wave Absorber and Wave Dark Room (written by Seki Yasuo, CMC Co., Ltd.) May, 1989).

Figure 3:
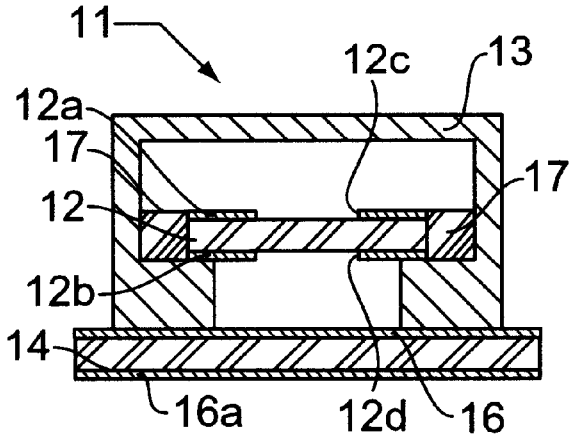
FIG. 3 is a sectional view showing a dielectric resonator according to the second embodiment.

A dielectric resonator 11 according to the second embodiment will be described below with reference to FIG. 3. FIG. 3 is a sectional view obtained at the same position as in FIG. 2.

As shown in FIG. 3, the dielectric resonator 11 is constituted by a dielectric substrate 12 having electrodes formed on both the major surfaces thereof and upper and lower conductive cases 13 and 14.

The dielectric substrate 12 has a predetermined specific inductive capacity, and an electrode 12*a* having one circular opening 12*c* and an electrode 12*b* having one circular opening 12*d* are formed on both the major surfaces of the dielectric substrate 12 such that the openings 12*c* and 12*d* oppose.

The upper conductive case 13 consists of a metal, and has a plate-like shape. The upper conductive case 13 is arranged near the opening 12*c* of the electrode 12*a* to be spaced apart from the dielectric substrate 12.

The lower conductive case 14 is constituted by a stepped annular metal portion and a dielectric substrate portion, and has a box-like shape which opens upward and has flanges projecting from the side surfaces of the lower conductive case 14. A shielding conductor 16 is formed on the inner peripheral surface of the lower conductive case 14, and a ground conductor 16*a* is formed on the lower surface of the lower conductive case 14. A microstrip line electrode (not shown) is formed at a position opposing the opening 12*d* of the electrode 12*b* to be insulated from the shielding conductor 16.

The dielectric substrate 12 and an annular member 17 consisting of a wave absorber are arranged on the step of the annular metal portion of the lower conductive case 14. At this time, the rectangular annular member 17 consisting of a wave absorber is arranged to be in contact with a side surface perpendicular to both the major surfaces of the dielectric substrate 12.

As described above, since the dielectric substrate 12 is arranged such that the side surface of the dielectric substrate 12 is in contact with the annular member 17 consisting of the wave absorber, an unnecessary mode electromagnetic wave transmitted through the dielectric substrate 12 and reflected by the conductor on the side wall can be absorbed.

Figure 4:
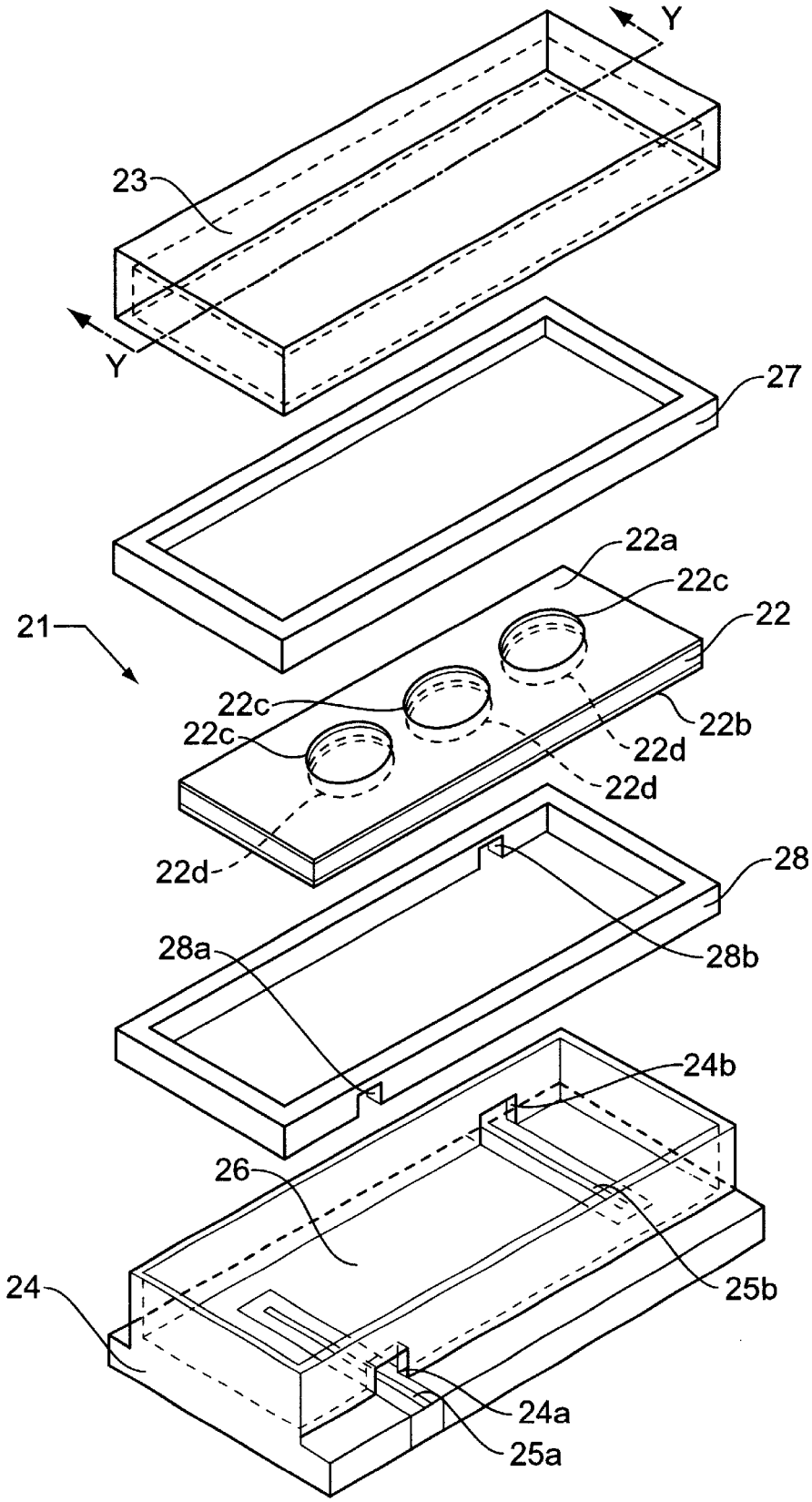
FIG. 4 is an exploded perspective view of a dielectric filter according to the third embodiment.
Figure 5:
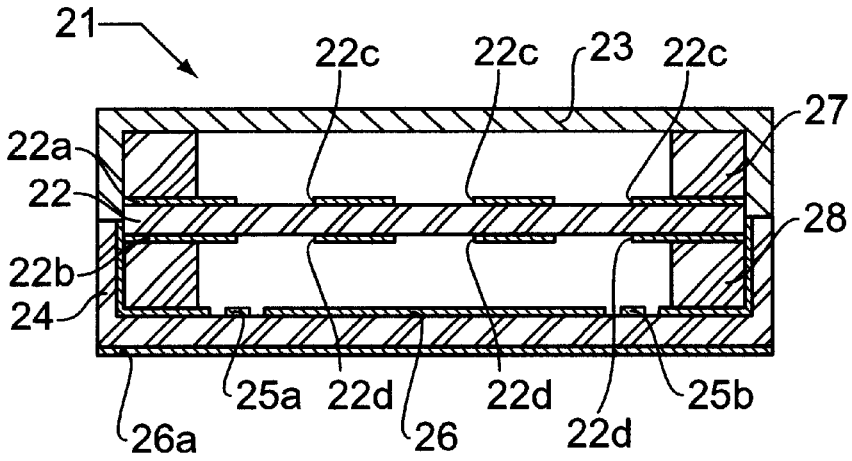
FIG. 5 is a sectional view showing the dielectric filter along a Y—Y line in FIG. 4.

The third embodiment will be described below with reference to FIGS. 4 and 5. FIG. 4 is an exploded perspective view of a dielectric filter 21 according to this embodiment, and FIG. 5 is a sectional view showing the dielectric filter 21 along a Y—Y line in FIG. 4.

As shown in FIG. 4, the dielectric filter 21 is constituted by a dielectric substrate 22 having electrodes formed on both the major surfaces thereof and upper and lower conductive cases 23 and 24.

The dielectric substrate 22 has a predetermined specific inductive capacity, and an electrode 22*a* having three circular openings 22*c* and an electrode 22*b* having three circular openings 22*d* are formed on both the major surfaces of the dielectric substrate 22 such that the openings 22*c* and 22*d* oppose.

The upper conductive case 23 consists of a metal, and has a box-like shape which opens downward. The upper conductive case 23 is arranged near the openings 22*c* of the electrode 22*a* to be spaced apart from the dielectric substrate 22.

The lower conductive case 24 consists of a dielectric material, and has a box-like shape which opens upward and has flanges projecting from the side surfaces of the lower conductive case 24. A shielding conductor 26 is formed on the inner peripheral surface of the lower conductive case 24. Input/output electrodes 25*a* and 25*b* are formed at a position opposing both the end openings 22*d* of the three openings 22*d* of the electrode 22*b* to be insulated from the shielding conductor 26. The input/output electrodes 25*a* and 25*b* are led from holes 24*a* and 24*b* formed in the side surface of the lower conductive case 24.

A rectangular annular member 27 consisting of a wave absorber is arranged between the inner ceiling surface of the upper conductive case 23 and the dielectric substrate 22.

As in the above arrangement, a rectangular annular member 28 consisting of a wave absorber is arranged between the inner bottom surface of the lower conductive case 24 and the dielectric substrate 22. Notches 28*a* and 28*b* are formed in the annular member 28 such that the annular member 28 is not in contact with the input/output electrodes 25*a* and 25*b*.

FIG. 5 is a sectional view showing the dielectric filter 21 along an X—X line in FIG. 4 viewed in the direction of an arrow. As shown in FIG. 5, the annular members 27 and 28 also function as spacers. That is, the annular member 27 keeps the interval between the dielectric substrate 22 and the upper conductive case 23 constant, and the annular member 28 keeps the interval between the dielectric substrate 22 and the lower conductive case 24 constant.

When the annular members 27 and 28 consisting of the wave absorber are arranged between the electrodes 22*a* and 22*b* of the dielectric substrate 22 and the upper and lower conductive cases 23 and 24 as described above, an unnecessary mode electromagnetic wave can be prevented from transmitting between the electrodes 22*a* and 22*b* of the dielectric substrate 22 and the upper and lower conductive cases 23 and 24.

In this embodiment, the rectangular annular member consisting of a wave absorber is used. However, the present invention is not limited to the embodiment, and, for example, a rod-shaped member may be used. At this time, when a rod-shaped member consisting of a wave absorber is arranged on at least one of the sides constituting the outer edge of the major surfaces of the dielectric substrate 22, the effect of suppressing an unnecessary mode electromagnetic wave can be obtained. However, when a member is shaped to surround the openings 22*c* and 22*d*, the best effect of suppressing an unnecessary mode electromagnetic wave can be obtained. For this reason, this shape is preferably used.

Figure 6:
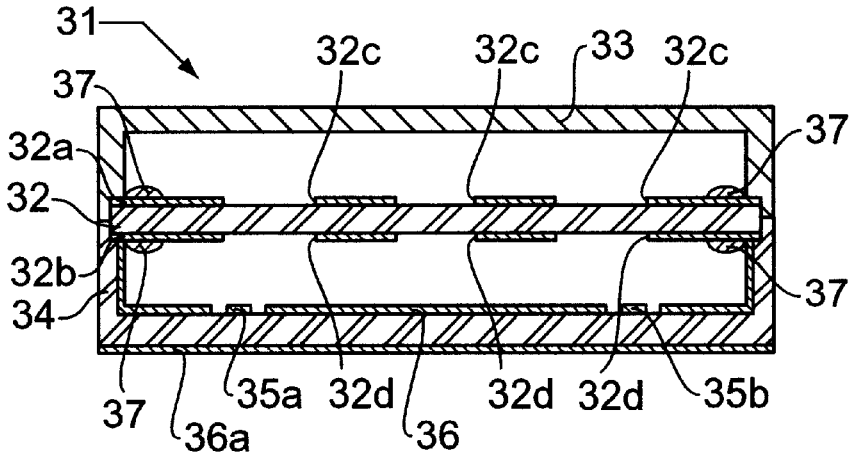
FIG. 6 is a sectional view showing a dielectric filter according to the fourth embodiment.

The fourth embodiment will be described below with reference to FIG. 6. FIG. 6 is a sectional view obtained at the same position as in FIG. 5.

In this embodiment, electromagnetic wave absorbing members 37 are formed in place of the rectangular annular members 27 and 28 in FIGS. 4 and 5.

More specifically, as shown in FIG. 6, in a dielectric filter 31, a paste-like wave absorber is coated and hardened on electrodes 32*a* and 32*b* formed on both the major surfaces of a dielectric substrate 32 and having openings 32*c* and 32*d* to form the electromagnetic wave absorbing members 37.

When the electromagnetic wave absorbing members 37 are formed between the electrodes 32*a* and 32*b* of the dielectric substrate 32 and the upper and lower conductive cases 33 and 34, an unnecessary mode electromagnetic wave can be prevented from transmitting the electrodes 32*a* and 32*b* of the dielectric substrate 32 and the upper and lower conductive cases 33 and 34.

Since the electromagnetic wave absorbing members 37 are not used as spacers in the above embodiment, support portions for the dielectric substrate 32 are formed on the upper conductive case 33 and the lower conductive case 34. In this case, although the electromagnetic wave absorbing members 37 are preferably formed to surround the openings 32*c* and 32*d*, the electromagnetic wave absorbing members 37 must be formed not to cross input/output electrodes 35*a* and 35*b*.

In addition, the electromagnetic wave absorbing members 37 are formed on the dielectric substrate 32 in this embodiment. However, the present invention is not limited to the embodiment, and the same effect can also be obtained by forming the electromagnetic wave absorbing members on the upper and lower conductive cases 33 and 34.

Figure 8:
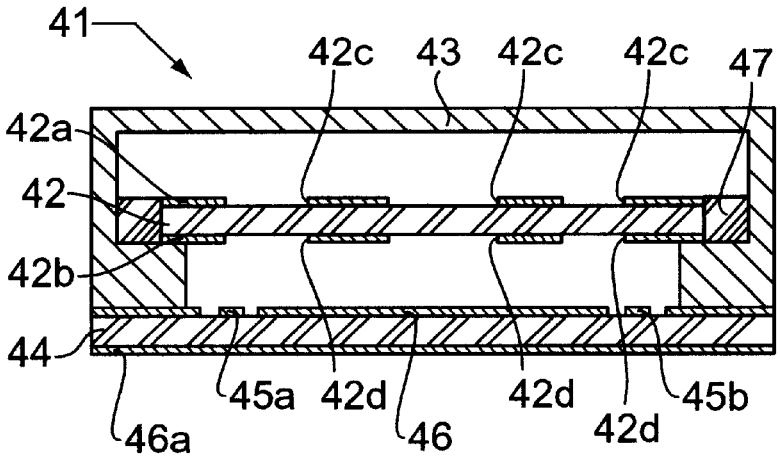
FIG. 8 is a sectional view showing the dielectric filter along a Z—Z line in FIG. 7.
Figure 7:
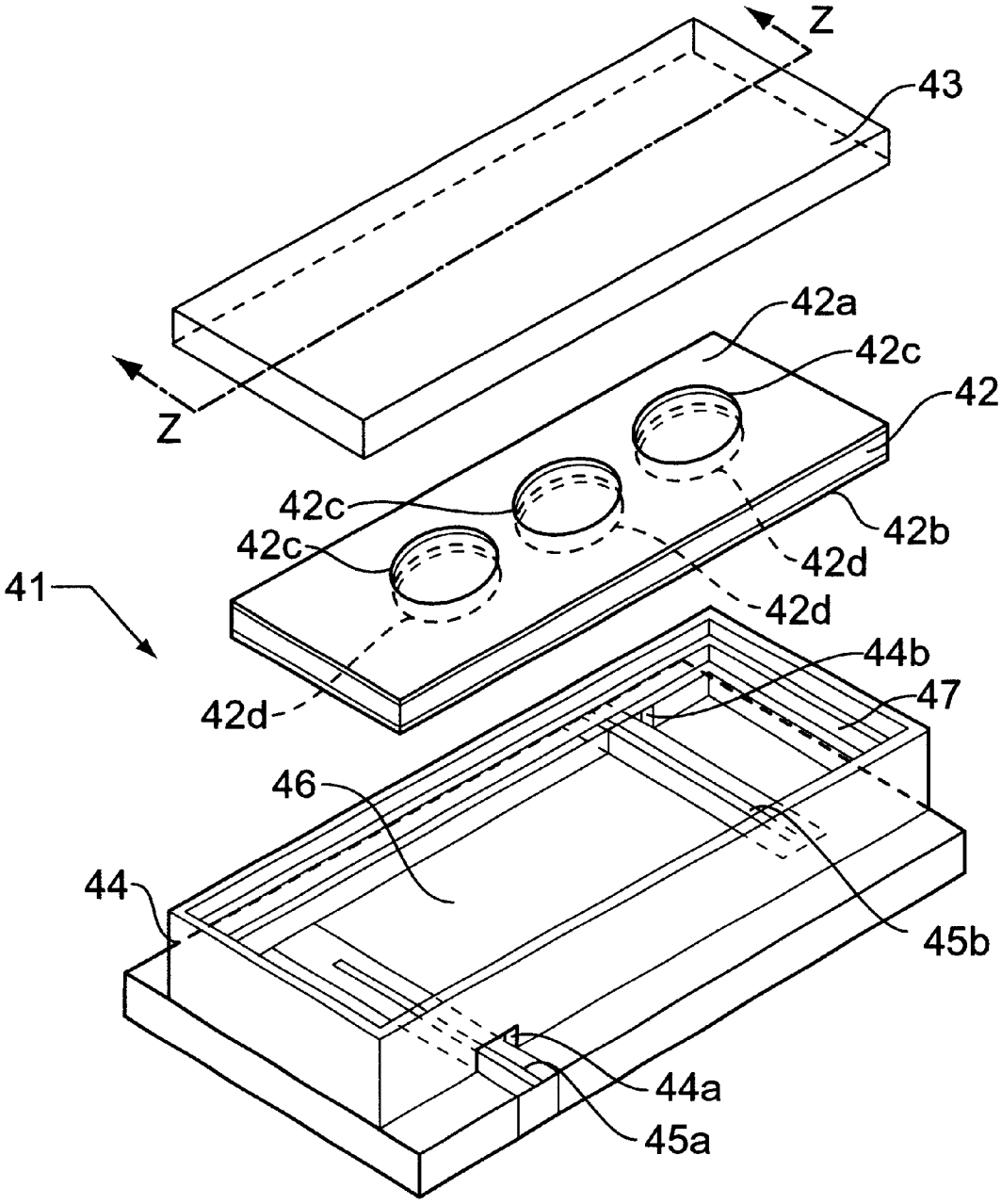
FIG. 7 is an exploded perspective view of a dielectric filter according to the fifth embodiment.

The fifth embodiment of the present invention will be described below with reference to FIGS. 7 and 8. FIG. 7 is an exploded perspective view of a dielectric filter 41 according to this embodiment, and FIG. 8 is a sectional view showing the dielectric filter along a Z—Z line in FIG. 7.

As shown in FIG. 7, the dielectric filter 41 is constituted by a dielectric substrate 42 having electrodes formed on both the major surfaces thereof and upper and lower conductive cases 43 and 44.

The dielectric substrate 42 has a predetermined specific inductive capacity, and an electrode 42*a* having three circular openings 42*c* and an electrode 42*b* having three circular openings 42*d* are formed on both the major surfaces of the dielectric substrate 42 such that the openings 42*c* and 42*d* oppose.

The upper conductive case 43 consists of a metal, and has a plate-like shape. The upper conductive case 43 is arranged near the openings 42*c* of the electrode 42*a* to be spaced apart from the dielectric substrate 42.

The lower conductive case 44 is constituted by a stepped annular metal portion and a dielectric substrate portion, and has a box-like shape which opens upward and has flanges projecting from the side surfaces of the lower conductive case 44. A shielding conductor 46 is formed on the inner peripheral surface of the lower conductive case 44, and a ground conductor 46*a* is formed on the lower surface of the lower conductive case 44. A microstrip line electrode (not shown) is formed at a position opposing the opening 42*d* of the electrode 42*b* to be insulated from the shielding conductor 46.

The dielectric substrate 42 and an annular member 47 consisting of a wave absorber are arranged on the step of the annular metal portion of the lower conductive case 44. At this time, the rectangular annular member 47 consisting of a wave absorber is arranged to be in contact with a side surface perpendicular to both the major surfaces of the dielectric substrate 42.

As described above, since the dielectric substrate 42 is arranged such that the side surface of the dielectric substrate 42 is in contact with the annular member 47 consisting of the wave absorber, an unnecessary mode electromagnetic wave transmitted through the dielectric substrate 42 and reflected by the conductor on the side wall can be absorbed.

Figure 9:
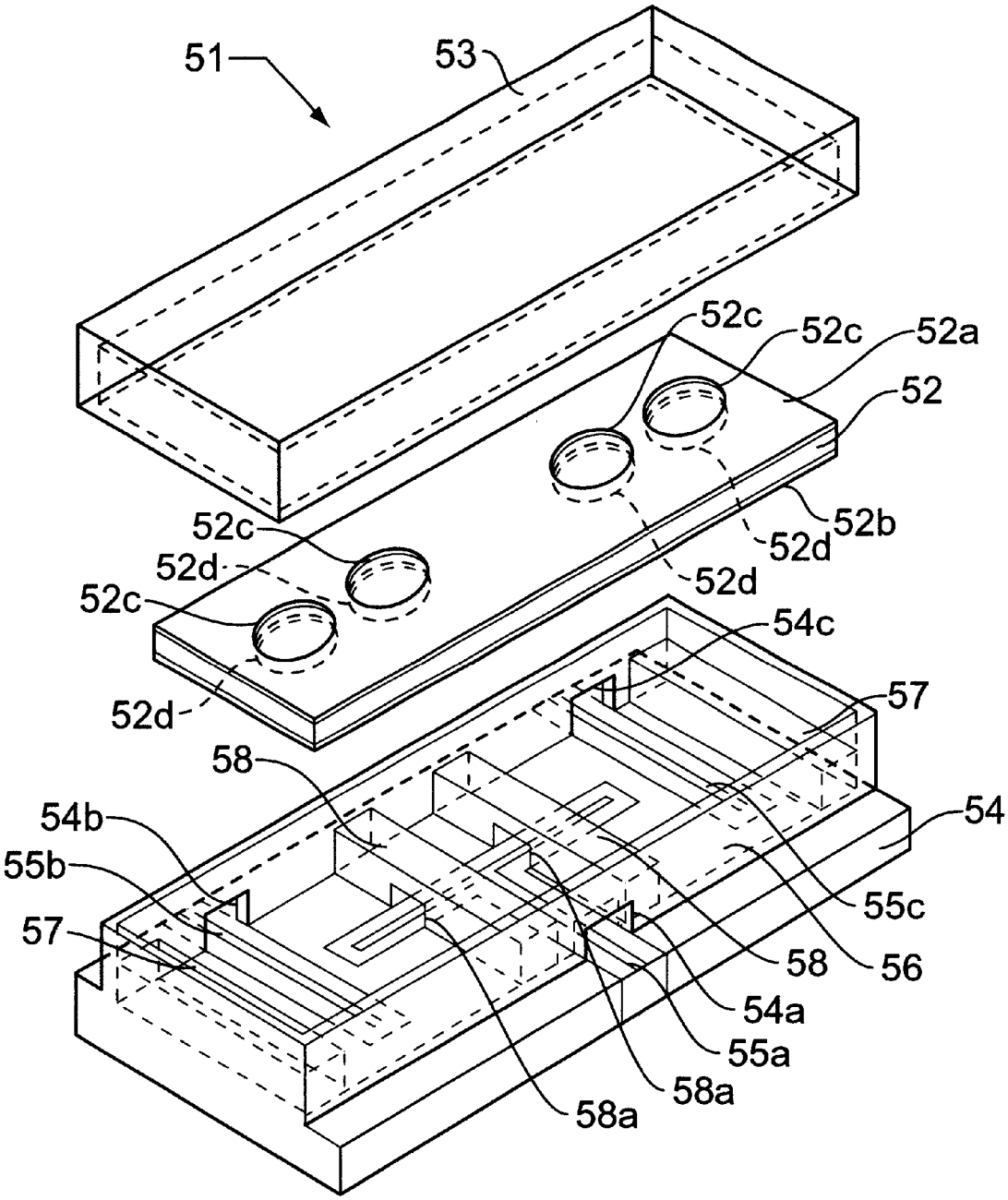
FIG. 9 is an exploded perspective view of a sharing device according to the sixth embodiment.

The sixth embodiment of the present invention will be described below with reference to FIG. 9. FIG. 9 is an exploded perspective view of a sharing device 51 according to the embodiment.

As shown in FIG. 9, the sharing device 51 is constituted by a dielectric substrate 52 having electrodes formed on both the major surfaces thereof and upper and lower conductive cases 53 and 54.

The dielectric substrate 52 has a predetermined specific inductive capacity, and an electrode 52*a* having four circular openings 52*c* and an electrode 52*b* having four circular openings 52*d* are formed on both the major surfaces of the dielectric substrate 52 such that the openings 52*c* and 52*d* oppose.

Two of the four openings 52*c* and two of the four openings 52*d* function as the resonance portion of the first filter, and the remains function as the resonance portion of the second filter.

The upper conductive case 53 consists of a metal, and has a box-like shape which opens downward. The upper conductive case 53 is arranged near the openings 52*c* of the electrode 52*a* to be spaced apart from the dielectric substrate 52.

The lower conductive case 54 consists of a dielectric material, and has a box-like shape which opens upward and has flanges projecting from the side surfaces of the lower conductive case 54. A shielding conductor 56 is formed on the inner peripheral surface of the lower conductive case 54. Microstrip line electrodes 55*a*, 55*b*, and 55*c* are formed at a position opposing the openings 52*d* of the electrode 52*b* to be insulated from the shielding conductor 56. The microstrip line electrodes 55*a*, 55*b*, and 55*c* are led from holes 54*a*, 54*b*, and 54*c* formed in the side surface of the lower conductive case 54.

Columnar members 57 and 58 consisting of a wave absorber are arranged between the inner bottom surface of the lower conductive case 54 and the dielectric substrate 52. Notches 58*a* are formed in the columnar member 58 such that the columnar members 58 are not in contact with the microstrip line electrode 55*a*.

The columnar members 58 also function as spacers. That is, the columnar members 57 and 58 keep the interval between the dielectric substrate 52 and the lower conductive case 54 constant.

When the columnar members 57 consisting of the wave absorber are arranged between the electrode 52*b* of the dielectric substrate 52 and the lower conductive case 54 as described above, an unnecessary mode electromagnetic wave can be prevented from transmitting between the electrode 52*b* of the dielectric substrate 52 and the lower conductive case 54.

Since the columnar members 58 are arranged to divide the two openings 52*d* constituting the first filter from the two openings 52*d* constituting the second filter, the resonance of the first filter and the resonance of the second filter can be prevented from being interfered to each other.

In this embodiment, the columnar members 57 and 58 are arranged on only the lower conductive case 54 side. The present invention is not limited to the embodiment, the columnar members 57 and 58 may be symmetrically arranged on the upper conductive case 53 side. In this case, an unnecessary mode electromagnetic wave can be prevented from transmitting, and resonances can be prevented from being interfered to each other. An annular wave absorber used in the dielectric filter 21 according to the third embodiment shown in FIG. 4 may be used. In this case, an unnecessary mode electromagnetic wave can be prevented from transmitting, and resonances can be prevented from being interfered to each other.

Figure 10:
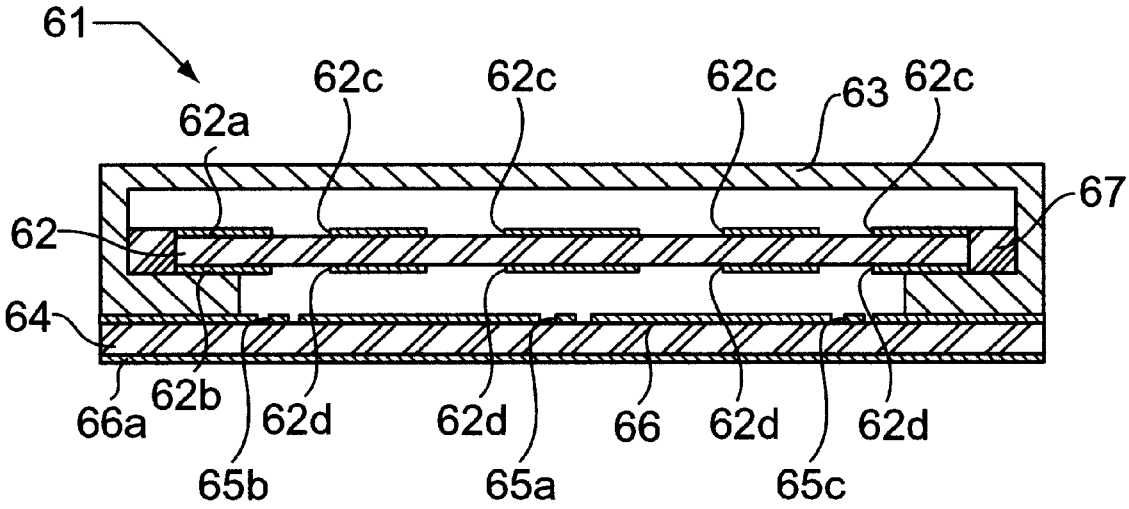
FIG. 10 is an sectional view of a sharing device according to the seventh embodiment.

The seventh embodiment of the present invention will be described below with reference to FIG. 10. FIG. 10 is a sectional view of a sharing device 61 according to this embodiment.

As shown in FIG. 10, the sharing device 61 is constituted by a dielectric substrate 62 having electrodes formed on both the major surfaces thereof and upper and lower conductive cases 63 and 64.

The dielectric substrate 62 has a predetermined specific inductive capacity, and an electrode 62*a* having four circular openings 62*c* and an electrode 62*b* having four circular openings 62*d* are formed on both the major surfaces of the dielectric substrate 62 such that the openings 62*c* and 62*d* oppose.

The upper conductive case 63 consists of a metal, and has a plate-like shape. The upper conductive case 63 is arranged near the openings 62*c* of the electrode 62*a* to be spaced apart from the dielectric substrate 62.

The lower conductive case 64 is constituted by a stepped annular metal portion and a dielectric substrate portion, and has a box-like shape which opens upward and has flanges projecting from the side surfaces of the lower conductive case 64. A shielding conductor 66 is formed on the inner peripheral surface of the lower conductive case 64, and a ground conductor 66*a* is formed on the lower surface of the lower conductive case 64. A microstrip line electrodes 65*a*, 65*b*, and 65*c* are formed at a position opposing the opening 62*d* of the electrode 62*b* to be insulated from the shielding conductor 66.

The dielectric substrate 62 and an annular member 67 consisting of a wave absorber are arranged on the step of the annular metal portion of the lower conductive case 64. At this time, the rectangular annular member 64 consisting of a wave absorber is arranged to be in contact with a side surface perpendicular to both the major surfaces of the dielectric substrate 62.

As described above, since the dielectric substrate 62 is arranged such that the side surface of the dielectric substrate 62 is in contact with the annular member 67 consisting of the wave absorber, an unnecessary mode electromagnetic wave transmitted through the dielectric substrate 62 and reflected by the conductor on the side wall can be absorbed.

Figure 11:
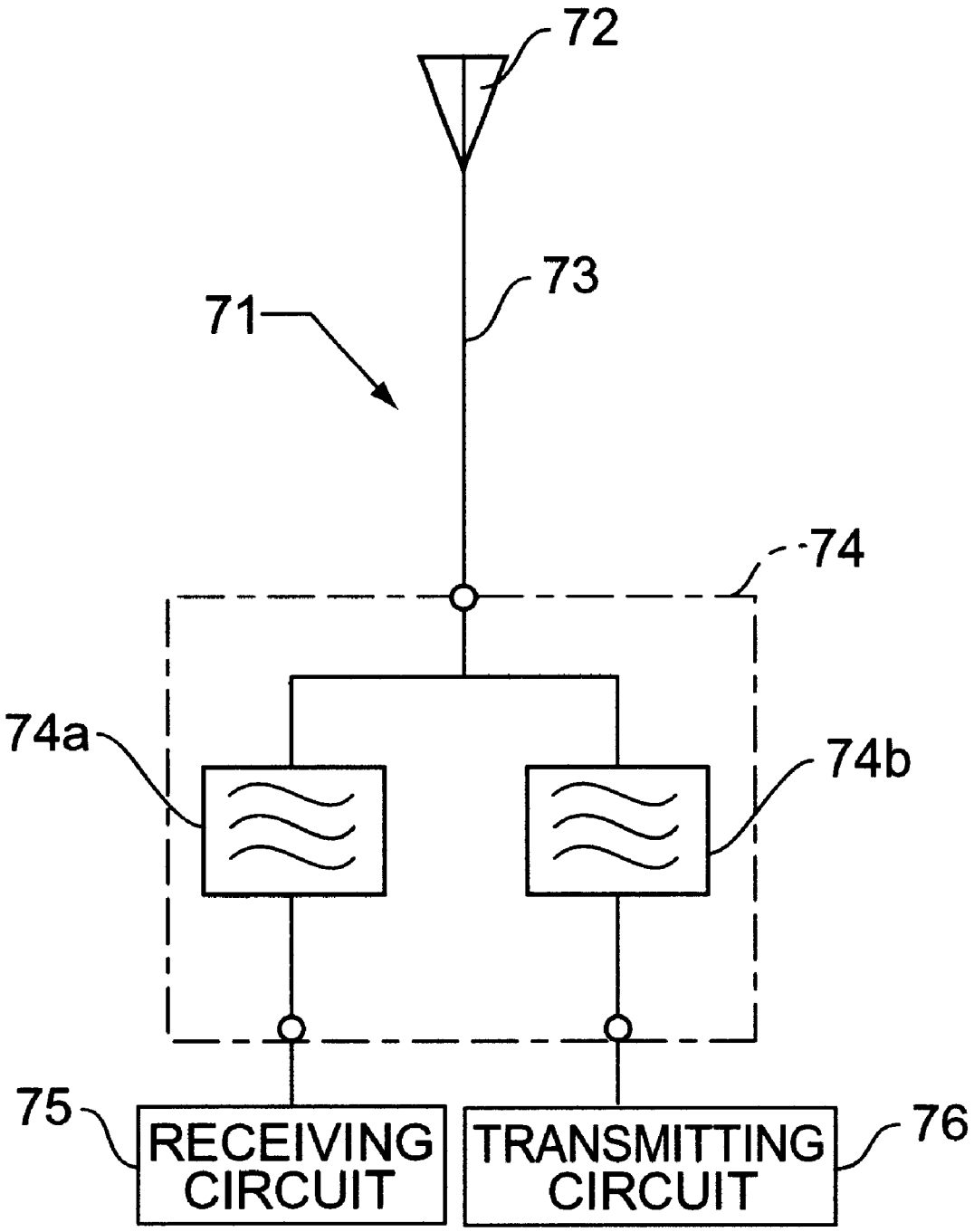
FIG. 11 is a block diagram of a communication apparatus according to the eighth embodiment.
Figure 12:
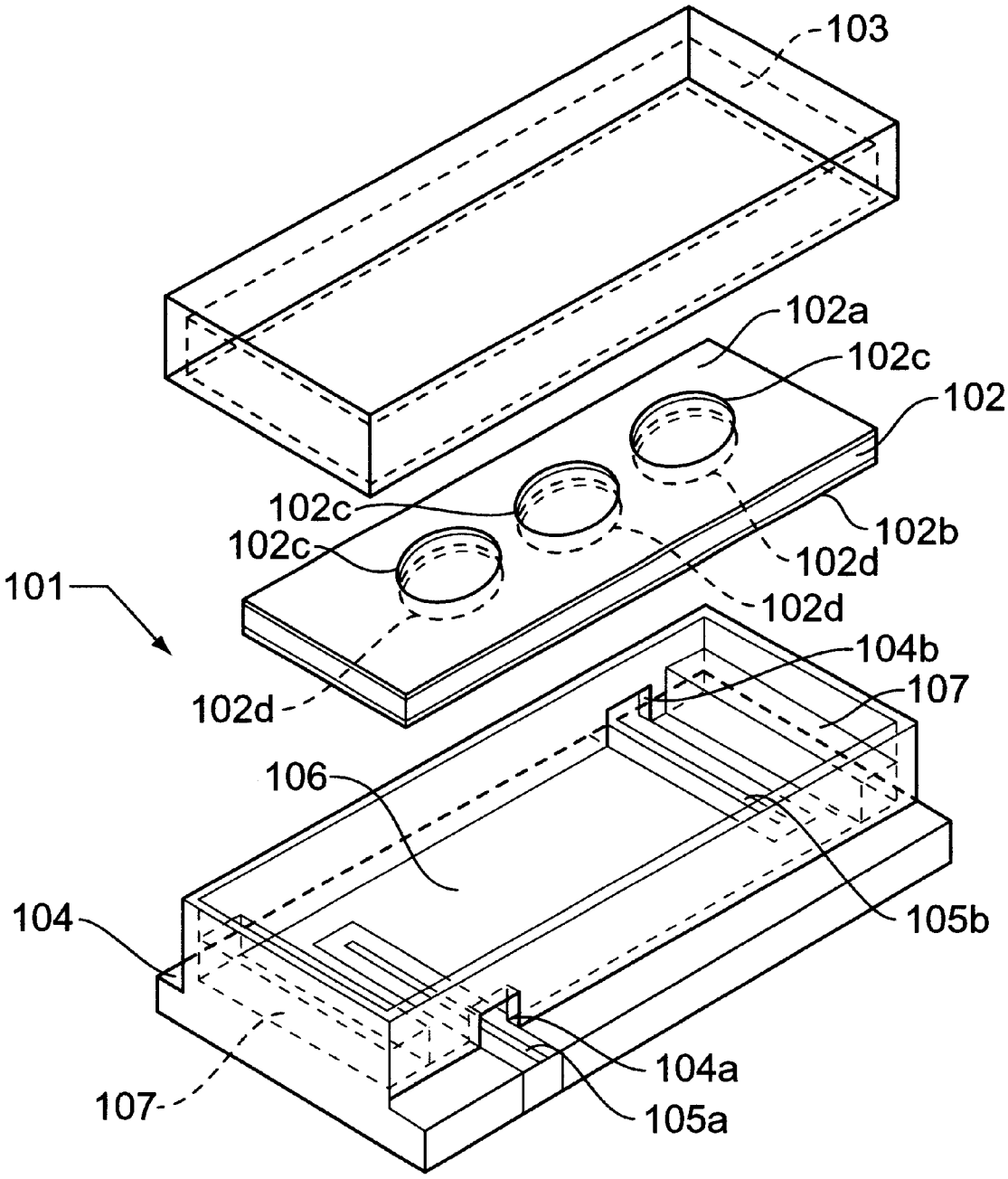
FIG. 12 PRIOR ART
FIG. 12 is an exploded perspective view of a dielectric filter which is proposed by the present applicant in advance.

A communication apparatus 71 according to the eighth embodiment will be described below with reference to FIG. 11. As shown in FIG. 11, the communication apparatus 71 is constituted by an antenna 72, a transmission path 73, a sharing unit 74, a reception circuit 75, and a transmission circuit 76.

The sharing unit 74 is constituted by a reception filter 74*a* and a transmission filter 74*b*, and one input terminal of the reception filter 74*a* and the output terminal of the transmission filter 74*b* are commonly connected to the sharing unit 74. The input/output terminals which are commonly connected are connected to the antenna 72 through the transmission path 73 to transmit/receive a high-frequency signal. The output terminal of the reception filter 74*a* is connected to the receiving circuit 75, and the input terminal of the transmission filter 74*b* is connected to the transmitting circuit 76.

As the sharing unit 74, the sharing devices 51 and 61 described in the sixth and seventh embodiments may be used. The dielectric resonators 1 and 11 and the dielectric filters 21, 31, and 41 which are described in the first to fifth embodiments may be used in the reception filter 74*a* or the transmission filter 74*b*, respectively.

Although the first to eighth embodiments have been described by using band-pass filters, the present invention is not limited to these embodiments. For example, the present invention can also be applied to a band stop filter, a trap filter, or the like.

As has been described above, according to the present invention, in each of the dielectric resonator, the dielectric filter, the sharing device, and the communication apparatus, when an electromagnetic wave absorbing member is arranged between the first and second conductors, an electromagnetic wave in a mode in which a spurious output acting as unnecessary resonance is generated can be suppressed, and preferable filter characteristics can be obtained.

In particular, when an electromagnetic wave absorbing member is formed between the electrode of the dielectric substrate and the first and second conductors, an unnecessary mode electromagnetic wave can be prevented from transmitting between the electrode of the dielectric substrate and the first and second conductors.

Since the electromagnetic wave absorbing member is in contact with the four side surfaces of the dielectric substrate, an unnecessary mode electromagnetic wave transmitting through the dielectric substrate can be absorbed.

What is claimed is:

1. A sharing device comprising:

at least a first filter and a second filter;

said first filter including a dielectric substrate, a first conductor formed on one major surface of said dielectric substrate, a second conductor formed on the other major surface of said dielectric substrate, a first opening formed in said first conductor to expose said dielectric substrate from said first conductor, a second opening formed in said second conductor to expose said dielectric substrate from said second conductor, a first conductive plate arranged to be spaced apart from said first conductor and to cover at least said first opening, a second conductive plate arranged to be spaced apart from said second conductor and to cover at least said second opening, a resonance portion determined by said first opening and said second opening, and input/output means coupled to said resonance portion, and said second filter including a dielectric substrate, a first conductor formed on one major surface of said dielectric substrate, a second conductor formed on the other major surface of said dielectric substrate, a first opening formed in said first conductor to expose said dielectric substrate from said first conductor, a second opening formed in said second conductor to expose said dielectric substrate from said second conductor, a first conductive plate arranged to be spaced apart from said first conductor and to cover at least said first opening, a second conductive plate arranged to be spaced apart from said second conductor and to cover at least said second opening, a resonance portion determined by said first opening and said second opening, and input/output means coupled to said resonance portion;

common input/output means which connects one of said input/output means of said first filter to one of said input/output means of said second filter; and an electromagnetic wave absorbing member arranged at at least one of a position between said first and second conductive plates of said first filter and a position between said first and second conductive plates of said second filter.

2. A sharing device according to claim 1, characterized in that said electromagnetic wave absorbing member is arranged at at least one of a position between at least one of said first and second conductive plates of said first filter and said dielectric substrate and a position between at least one of said first and second conductive plates of said second filter and said dielectric substrate.

3. A sharing device according to claim 2, characterized in that said electromagnetic wave absorbing member is arranged to separate said resonance portion of said first filter and said resonance portion of said second filter from each other.

4. A sharing device according to claim 1, characterized in that said electromagnetic wave absorbing member is arranged to be in contact with at least one of a side surface perpendicular to both the major surfaces of said dielectric substrate of said first filter and a side surface perpendicular to both the major surfaces of said dielectric substrate of said second filter.

5. A communication apparatus comprising at least a sharing device, a transmission circuit, a reception circuit, and an antenna, wherein said sharing device includes: a first filter having a dielectric substrate, a first conductor formed on one major surface of said dielectric substrate, a second conductor formed on the other major surface of said dielectric substrate, a first opening formed in said first conductor to expose said dielectric substrate from said first conductor, a second opening formed in said second conductor to expose said dielectric substrate from said second conductor, a first conductive plate arranged to be spaced apart from said first conductor and to cover at least said first opening, a second conductive plate arranged to be spaced apart from said second conductor and to cover at least said second opening, a resonance portion determined by said first opening and said second opening, and input/output means coupled to said resonance portion; a second filter having a dielectric substrate, a first conductor formed on one major surface of said dielectric substrate, a second conductor formed on the other major surface of said dielectric substrate, a first opening formed in said first conductor to expose said dielectric substrate from said first conductor, a second opening formed in said second conductor to expose said dielectric substrate from said second conductor, a first conductive plate arranged to be spaced apart from said first conductor and to cover at least said first opening, a second conductive plate arranged to be spaced apart from said second conductor and to cover at least said second opening, a resonance portion determined by said first opening and said second opening, input/output means coupled to said resonance portion; common input/output means which connects one of said input/output means of said first filter to one of said input/output means of said second filter; and an electromagnetic wave absorbing member arranged at at least one of a position between said first and second conductive plates of said first filter and a position between said first and second conductive plates of said second filter, said transmission circuit is connected to said first filter, said reception circuit is connected to said second filter, and said antenna is connected to said common input/output means.

6. A communication apparatus according to claim 5, characterized in that said electromagnetic wave absorbing member is arranged at at least one of a position between at least one of said first and second conductive plates of said first filter and said dielectric substrate and a position between at least one of said first and second conductive plates of said second filter and said dielectric substrate.

7. A communication apparatus according to claim 5, characterized in that said electromagnetic wave absorbing member is arranged to separate said resonance portion of said first filter and said resonance portion of said second filter from each other.

8. A communication apparatus according to claim 5, characterized in that said electromagnetic wave absorbing member is arranged to be in contact with at least one of a side surface perpendicular to both the major surfaces of said dielectric substrate of said first filter and a side surface perpendicular to both the major surfaces of said dielectric substrate of said second filter.

9. A dielectric resonator comprising:

a dielectric substrate;

a first conductor formed on one major surface of said dielectric substrate;

a second conductor formed on the other major surface of said dielectric substrate;

a first opening formed in said first conductor to expose said dielectric substrate through said first conductor;

a second opening formed in said second conductor to expose said dielectric substrate through said second conductor;

a first conductive plate arranged to be spaced apart from said first conductor and to cover at least said first opening;

a second conductive plate arranged to be spaced apart from said second conductor and to cover at least said second opening;

a resonance portion determined by said first opening and said second opening; and an electromagnetic wave absorbing member arranged between said first and second conductive plates;

characterized in that said electromagnetic wave absorbing member is arranged to be in contact with a side surface perpendicular to both the major surfaces of said dielectric substrate.

10. A dielectric filter comprising:

a dielectric substrate;

a first conductor formed on one major surface of said dielectric substrate;

a second conductor formed on the other major surface of said dielectric substrate;

a first opening formed in said first conductor to expose said dielectric substrate through said first conductor;

a second opening formed in said second conductor to expose said dielectric substrate through said second conductor;

a first conductive plate arranged to be spaced apart from said first conductor and to cover at least said first opening;

a second conductive plate arranged to be spaced apart from said second conductor and to cover at least said second opening;

a resonance portion determined by said first opening and said second opening;

an input/output connector coupled to said resonance portion; and an electromagnetic wave absorbing member arranged between said first and second conductive plates;

characterized in that said electromagnetic wave absorbing member is arranged to be in contact with a side surface perpendicular to both the major surfaces of said dielectric substrate.

* * * * *